United States Patent [19]

Grund

[11] Patent Number: 4,697,954

[45] Date of Patent: Oct. 6, 1987

[54] BASEMENTED FLOOR STRUCTURE FOR A WASTE DUMP

[76] Inventor: Karl Grund, Nachtigallenweg 5, D-6238 Hofheim/Ts., Fed. Rep. of Germany

[21] Appl. No.: 807,589

[22] Filed: Dec. 11, 1985

[30] Foreign Application Priority Data

Dec. 11, 1984 [DE] Fed. Rep. of Germany ..... 3445127

[51] Int. Cl.[4] ..... B09B 1/00

[52] U.S. Cl. ..... 405/128; 405/52; 405/57; 405/270

[58] Field of Search ..... 405/36–38, 405/52–55, 57, 128, 129, 132, 134, 135, 149, 229, 258, 266, 267, 270; 252/633; 52/169.5, 322, 323, 329, DIG. 10

[56] References Cited

U.S. PATENT DOCUMENTS

| | | | |
|---|---|---|---|
| 3,334,458 | 8/1967 | Leemhuis | 52/329 X |
| 3,383,816 | 5/1968 | Hodson | 52/329 X |
| 3,729,939 | 5/1973 | Shimizu | 405/135 |
| 3,848,418 | 11/1974 | Takase et al. | 405/267 X |
| 3,922,823 | 12/1975 | King et al. | 405/53 X |
| 4,352,601 | 10/1982 | Valiga et al. | 405/270 |
| 4,362,434 | 12/1982 | Valiga et al. | 405/128 |
| 4,464,081 | 8/1984 | Hillier et al. | 405/128 |

OTHER PUBLICATIONS

"Recycling International" article by Dr. Karl Heinz Narjes and Dr. Heinz Riesenhuber, pp. 1063–1069, 1984.

*Primary Examiner*—Nancy J. Stodola
*Attorney, Agent, or Firm*—Richard G. Stephens

[57] ABSTRACT

A basemented floor structure under a waste dump, whereby the burden of the waste body is transferred to piers and then onto foundations and the subgrade, and on which layers of sealing material, drainage material or protective material lie, is built up from individual support elements separated from one another by seams and having an upwardly convex or concave shape. By this structure, unequal setting of the subgrade can be accommodated without harm and cracks in the floor structure are prevented. The upper surfaces of the support element are inclined toward the piers. The seepage is taken from collecting zones through a water removal system to a purification plant.

14 Claims, 11 Drawing Figures

BASEMENTED FLOOR STRUCTURE FOR A WASTE DUMP

FIELD OF THE INVENTION

The present invention relates to a floor structure for a waste dump and more particularly to floor structure for a waste dump which includes a basement and a water removal system for the seepage water.

BACKGROUND OF THE INVENTION

Very recently it has been proposed to prevent possible contamination of the soil and of ground water underneath waste dumps by creating a basement-like cavity underneath the dump.

Such a basemented dump is intended for the purpose of reliably catching and collecting seepage, of being able to examine the sealing system for its reliability at any time and in a simple manner, and to detect and repair damage quickly. It is furthermore intended to permit leakage or seepage to be trapped by a second system in case of damage.

Sealing by means of a basement-like cavity is many times more expensive and complex than the seals used heretofore, but it provides the advantage of being able in a simple manner to inspect the seals visually and make them secure at any time.

In one known embodiment, the dumped material rests on a concrete slab which has a basement underneath it. The basement can be walked through. The concrete structure can be made of poured concrete or built up of precast blocks. The main sealing function is performed by an overhead plastic membrane (similar to a suspended ceiling) which conforms as tightly as possible to the underground roof and has elastic properties.

The top surface of the platform is divided into individual fields by raised boundaries. The seepage water is collected field by field and analyzed for quality.

These known proposals do not take into consideration the great deformations to which such a structure is exposed under the burden of the dumped material on an always more or less compressible subgrade. The consequences of these deformations are added tensions and possibly also cracking in the structure, which can defeat its purpose. In view of this cracking, which is considered inevitable, the suspended water-tight cover is therefore arranged underneath the actual concrete roof, and the seepage penetrating through the cracks and seams of the structure are caught by this cover and removed.

The sealing problem cannot be solved in this manner, because the seepage, which is laden with a great variety of harmful substances, would attack the load-bearing structure itself, beginning at the seams, and possibly destroy it.

Another danger which has not been recognized and dealt with accordingly in the known floor construction results from the great horizontal forces which can act on the structure, for example, in the case of an earthquake.

OBJECTS OF THE INVENTION

Accordingly, it is the object of the present invention to improve a basemented floor structure under a waste dump, which can be inspected and repaired at any time, such that it will withstand heavy loads for long periods of time and is permanently water-tight, and also can adapt itself harmlessly to the deformations of the subgrade.

SUMMARY OF THE INVENTION

These and other objects of the invention are achieved by the fact that the floor structure consists of individual supporting elements of upwardly convex or concave form, separated by seams from one another, whose surface slopes toward the feet which rest on piers arranged in a regular pattern, and which simultaneously form zones for the gathering of seepage, which are connected to the purifying plant by the water removal system.

The individual supporting elements, separated from one another by seams, transmit their loads onto the piers disposed in the pattern, which are provided with foundations corresponding to the soil conditions, such as simple block slab foundations. The shape of the supporting elements assures that the seepage will flow, without crossing a seam, over a short path to the corresponding collecting area, from whence it is carried away to the purification plant in appropriate drain lines. There can be more than one water removal system so as to separate the seepage from various zones according to their pollutant content and treat it separately.

Embodiments of the invention will now be explained, in conjunction with the drawing, wherein:

DETAILED DESCRIPTION

Figure 1:
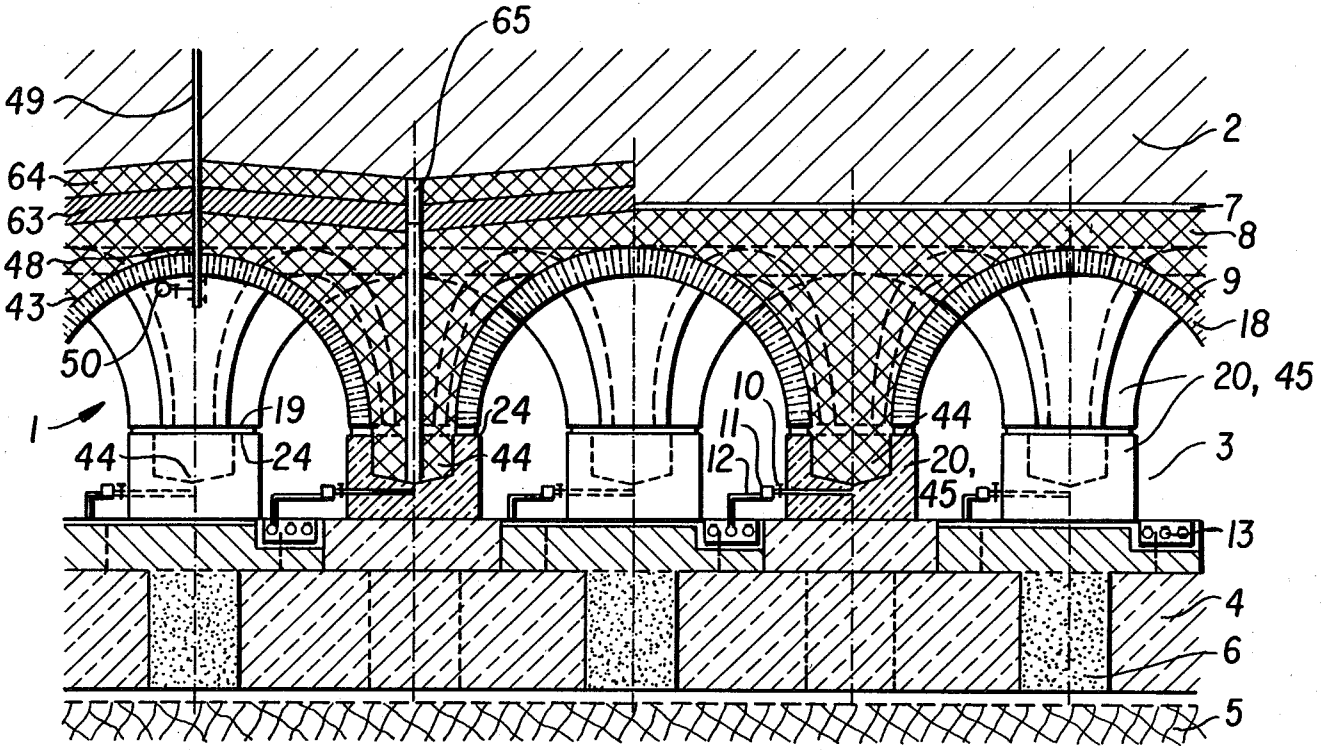
FIG. 1 is a cross section along line I/I of FIG. 2.
Figure 2:
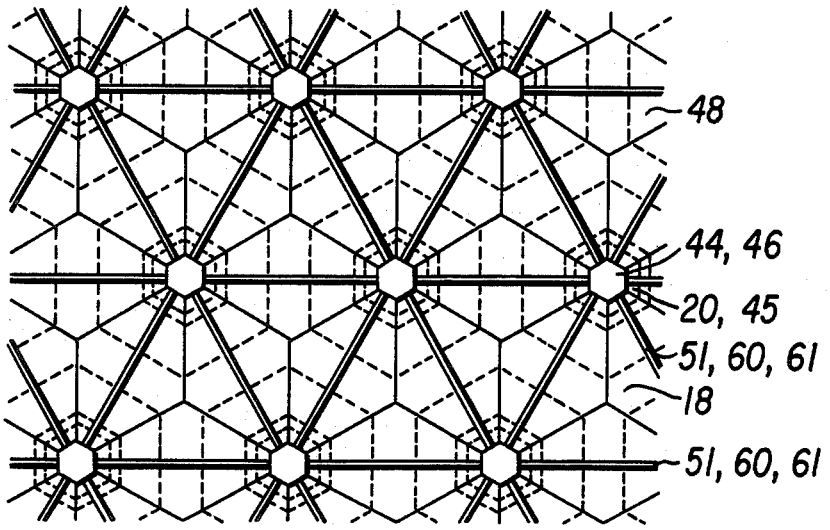
FIG. 2 is a diagrammatic plan view of a floor structure according to FIG. 1.

FIGS. 1 and 2 show a floor structure 1 having triangular cross vaults 18 over solid piers 20 or hollow piers 45.

Figure 3:
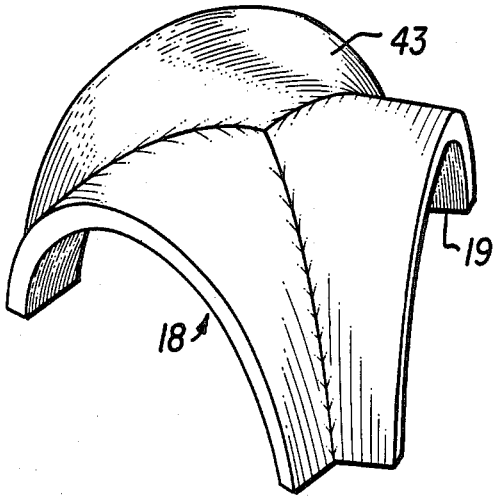
FIG. 3 is a first embodiment of a supporting element.
Figure 4:
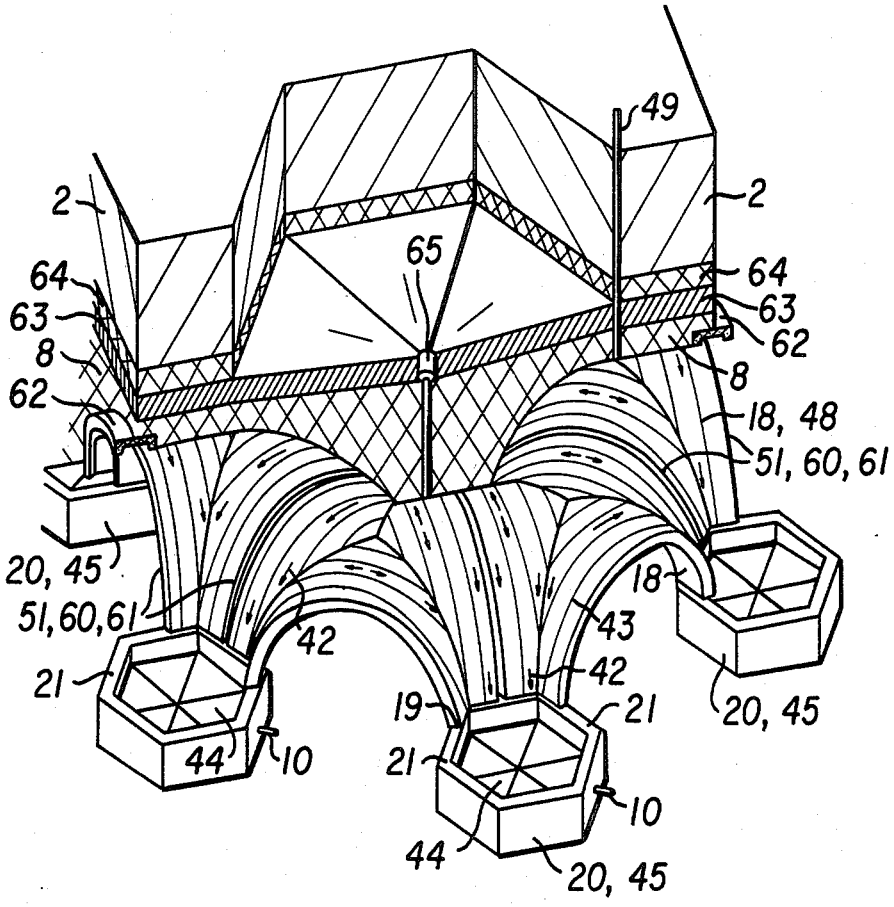
FIG. 4 is an orthographic projection representing a partial view of a floor structure having supporting elements according to FIG. 3.

FIG. 3 shows a single triangular cross vault in an orthographic projection, whereas FIG. 4 is an orthographic projection of a section through the floor structure 1 having triaxial cross vaults 1B, and a body of dumped waste matter above it. In the description that follows of the first embodiment, reference is made to FIGS. 1 to 4.

The seepage flowing from the collecting zones can first pass for visual inspection through a viewing glass which is equipped with a system for measuring the amount of seepage and with a cock for taking samples. Then the seepage flows through a flexible hose which can be changed about, into a line for the removal of the corresponding class of seepage.

The supporting elements can be constructed in detail as follows: The floor structure (1) consists of individual support elements (18, 23, 28, 33, 38) of upwardly convex or concave form, separated from one another by seams (51, 60, 61), the upper surface (43) of the support elements being inclined toward the feet (19, 24, 29, 34, 39) which rest on piers (20, 25, 30, 35, 40) arranged in a pattern and which simultaneously form collecting zones (44) for the seepage which are connected to the purifying plant through the water removal system.

The supporting elements can be triaxial, upwardly convex cross vaults or gable structures (18) whose feet (19) rest upon hexagonal marginal areas (21) of the piers (20).

Likewise the supporting elements may be:

(a) four-axis, upwardly convex cross vaults or gable structures (23) whose feet (24) rest upon square marginal areas (26) of the piers (25).

(b) sexaxial, upwardly convex cross vaults or gable structures (28) whose feet (29) rest upon hexagonal marginal areas (31) of the piers (30).

(c) triangular, quadrangular or hexagonal, upwardly concave, hopper-like structural parts (33, 38) whose feet (34, 39) rest upon correspondingly shaped marginal areas (36, 41) of the piers (35, 40).

It is noted that cross vaults or gable structures are equivalent elements of construction.

Preferably, the upwardly convex supporting elements are configured as triaxial cross vaults or vault-like gables which rest in a statically determined manner on three feet, so that they will be able to follow any unequal settling of their feet without permanent tensions. Upwardly concave supporting elements are, for the same reason, given preferably only one central pier.

Each pier must serve two functions, namely it must on the one hand transmit the load forces of the supporting elements to the foundations, and on the other hand it forms the collecting zone for collecting the seepage flowing down on the back of the supporting elements. The cavity in the hollow piers and immediately over the supporting elements is filled with a highly permeable material (sand, gravel, etc.) and well compacted. The shape of the vault or of the gables is configured according to the line of support so that is is given only compressive stress and any flexural stresses that may occur remain small.

Since the horizontal tensions in the fill over the vault are always lower than the corresponding vertical tensions from the burden of the dump, the line of support is an upright semi-ellipse.

To forestall the danger of the destruction of the floor structure by seepage containing pollutants, the cavities and the surfaces are treated so that the inclined upper surface (43) of the support elements (18, 23, 28, 33, 38) and the cavities (46) of the hollow piers (45) are provided with a one-layer or multi-layer seal (9) of protective material resistant to seepage liquid.

The supporting elements have closable openings through which lances can be forced upwardly into the waste body can be introduced into the dumped material. By means of these lances, measurements can be performed in the dumped material of parameters of the chemical, physical or biological processes in progress therein, and substances can be injected or withdrawn.

Depending on the deformity of the chosen supporting elements or of the material of which they are built, and the anticipated deformation of the subgrade, the seams between the individual supporting elements according to claims 4 to 12 remain movable over the entire lifetime of the floor structure, or the close when the movements cease, or they can be made tight from the beginning if this is permitted by the ability of the structure to change shape to accommodate anticipated deformation of the subgrade, and if the load-bearing ability and impermeability of the structure are assured.

Movable seams are carried only along a descending line, so that no seepage will flow to them, but will only flow downwardly parallel to the seam. The cover block lying over the seam serves to bridge the open seam and to transmit the static load in this area onto the two adjacent supporting elements. Between the outer sealing system (primary system) confronting the dumped material, and the inner sealing system (secondary seal) disposed toward the interior, there is a freely draining chamber out of which any seepage that may have penetrated can be let out in a controlled manner. In the case of a leak in the outer sealing system, therefore, the seepage entering into this chamber can be captured and released harmlessly. This chamber, however, can also be waterproofed with an appropriate composition, this composition being such that it can be removed again and replaced with a new one at any time and as often as desired, from the inside.

It is advantageous if over the supporting elements and the layer of protective material, as well as over the layer of drainage material over that, an additional seal coat sloping over the seepage collecting zones is disposed, with a drainage layer over it, which is connected by vertical drainpipes to the seepage collecting zones and to the system for removing the seepage.

By means of this advance seal coat, most of the seepage can be fed through the vertical drainpipe to the collecting zones in the same manner, without the seepage coming in contact with the surfaces of the supporting elements. The stress on the seal coat on the surface of the supporting elements is thus reduced and at the same time its useful life is lengthened.

First, however, it will be pointed out that the triangular cross vault 18 according to FIG. 3 is only one possibility for the design of Example 1 of the invention. Instead of the triaxial cross vault 18, a three-gabled structure can also be used. Any person skilled in the art is capable of replacing cross vaults with corresponding gables within the scope of the present invention.

Underneath the triaxial cross vault 18 lies a basement 3 which can be walked through, and from which the seams, which are to be explained in detail hereinafter, and the components of the water removal system can be inspected and repaired.

A triaxial cross vault 18 consists of three permanently joined vault sections having an outer surface 43. The surface 43 of the triaxial cross vault 18 is of such a nature that the seepage drains along the water flow arrows 42.

The individual support elements or triaxial cross vaults 18 are separated from one another by seams 51, 60, and 61, which will be explained in detail later on.

Each triaxial cross vault 18 stands on three feet 19. In this case the feet 19 rest on piers 20 and 45, respectively. If triaxial cross vaults 18 or corresponding triaxial gables are used, the feet 19 rest on the corresponding marginal areas of solid piers 20 or hollow piers 45, as they are represented in FIGS. 1 and 4. The piers 20 and 45 have, as seen particularly in FIG. 4, hexagonal marginal areas 21 for the feet 19. In FIGS. 1, 2, 3 and 4 it can be seen that the entire floor structure 1 of the waste dump is composed of individual support elements 18 separated from one another by seams and are of convex configuration at the top. In this manner, collecting zones 44 for the seepage are formed, which are distributed through the floor structure, and, as seen in FIG. 1, they are connected by a cavity 46 in the hollow pier 45 or, in the case of solid piers 20, directly to a drain pipe 10 which can be closed off by a valve. This drain pipe passes through an inspection glass 11 into a selector hose 12 which can be connected to any of the discharge lines 13. Also, an opening can be provided together with the inspection glass 11 for the taking of samples of seepage. The selector hose 12 is connected, on the basis of the sample taken, to the discharge line 13 that is intended for the particular type of seepage.

FIGS. 1 and 4 show that a layer 8 of drainage material is supported on the floor structure 1 whose surface 43 is clad with a layer of protective material 9, and that it is sealed off by a separatory layer 7. Above this separatory layer 7 is the actual body of waste material 2.

On the left side of FIG. 1, and in FIG. 4, it can furthermore be seen that, over the layer 8 of drainage material a sealing layer 63 and a drainage layer 64 can be provided. In preferred examples of embodiment, the waste body 2 lies on the drainage layer 64. The sealing layer 63 and the drainage layer 64 slope downwardly. At the lowest point, vertical drainpipes 65 are disposed which lead to the lowermost point of the collecting zone 44 or of the hollow piers 45, as the case may be.

According to the invention, consequently, the seepage is removed in two ways: on the one hand through the vertical drainpipes 65 and on the other hand along the water flow arrows 42 over the surfaces 43 of the triaxial cross vault 18. At the same time it is important that most of the seepage that enters is carried down the surface of the sealing layer 63 through the vertical drainpipes 65, and thereby the aggressive seepage is kept as far as possible away from the surfaces 43 of the triaxial cross vault 18. From the figures it can be seen that the water flow arrows 42 never cross any of the seams 51, 60, 61. This feature of the floor structure 1 contributed importantly to its impermeability.

The burden of the waste body 2 is transmitted through the triaxial cross vault 18 and through the piers 20 or 45 to foundations 4 which transmit the burden to the subgrade 5. Between the slab foundations 4, a fill of unconsolidated material 6 is provided. This brings it about that expansion can occur as a result of the dishing produced by settling, but that then this expansion cannot be reversed.

FIGS. 1 and 4 furthermore indicate closable openings 48 through which lances 49 can be thrust upwardly into the waste body 2. In the embodiment represented, the lances 49 are connected to gas lines 50. A portion of the lances 49 can also be used for performing measurements of state parameters, such as, for example, temperature, oxygen content, etc., in the waste matter, or for feeding substances into it, and for monitoring physical, chemical, or biological degradation processes taking place in the waste matter, and for influencing their course. It is important that the sealing layer 63 can be made of material that is cheap in relation to the layer of protective material 9. By this layer, most of the seepage can be intercepted and fed to the vertical drainpipes 65. In this manner the expensive layer 9 of protective material can be safeguarded and its useful life can be prolonged.

In case the nature of the subgrade 5 does not permit simple block foundations 4, other types of foundation, such as pile foundations or the like can be created.

In case of a very inhomogeneous and soft subgrade, the danger might exist that, in the event of a partial loading of the floor structure 1, the pier foundations might shift against one another thus producing tensions in the supporting elements. Since the dishing produced by settling under the dump has to result in a slight increase of the distance between piers and this movement must not be hindered, the spaces between the block foundations 4 are filled, as already mentioned, with unconsolidated material 6, such as bank-run gravel, which automatically settles down and prevents the slabs from being pushed together at the same or at a different point. The floor structure 1 according to the invention can therefore only expand, as it has to anyway, in order to follow the settling. According to the invention, however, the floor structure is prevented from expanding any more than necessary and from crowding at another point to compensate for it.

Quite generally, the supporting elements, including therefore the cross vaults 18 and the piers 20 and 45, can be made of a variety of materials and by a variety of methods of construction. The materials can be steel concrete, steel fiber concrete, cast steel, steel, GVK [glasfaserverstaerkter Kunststoff=glass fiber reinforced plastic] and other such strong materials that are as resistant as possible to the pollutant-charged seepage. In the case of concrete construction, poured concrete as well as precast concrete units can be used. Parts made from cast iron or from steel in separate components of smaller dimensions can be transported easily and then bolted or welded together into larger units at the worksite. FIG. 4 shows cover blocks 62 on the seams that are to be explained in detail further below; in preferred embodiments, these cover blocks are placed over the seam area that is to be protected.

FIGS. 5, 6, 7 and 8 are diagrammatic representations of additional embodiments of the invention.

Figure 5:
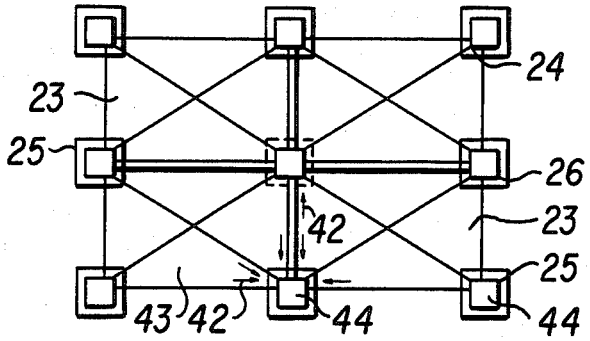
FIG. 5 is a diagrammatic plan view of a floor structure having quadrangular supporting elements.

FIG. 5 shows a top plan view of a floor structure 1 with quadriaxial cross vaults 23. These have feet 24 which rest on square marginal areas 26 of piers 25. The piers can be solid piers of the zones for the collection of seepage are connected directly to the drainage system 10, 11, 12 and 13. But they can also be in the form of hollow piers.

Figure 6:
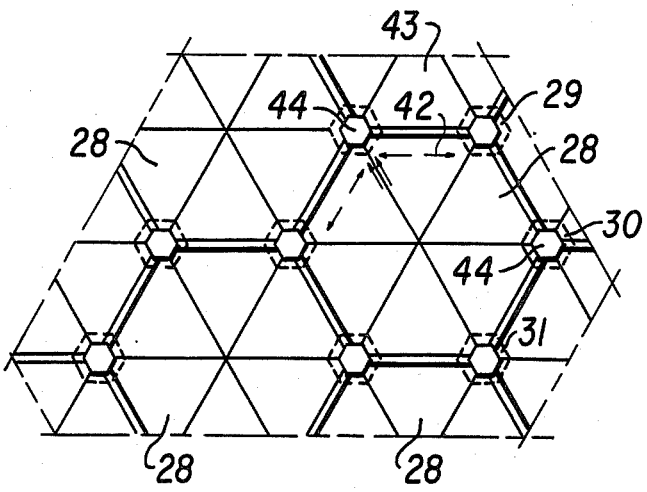
FIG. 6 is a diagrammatic plan view of a floor structure having hexagonal supporting elements.

FIG. 6 shows a diagrammatic top plan view of sexaxial cross vaults on which a floor structure 1 can be built with the interposition of seams 51, 60 and 61. The sexaxial cross vaults 28 have feet 29 which can rest on hexagonal marginal areas 31 of piers 30.

Floor structures 1 which are built in accordance with the diagrammatic drawings of FIGS. 5 and 6 furthermore have all of the features which have been explained in conjunction with FIGS. 1 to 4. Again the case of floor structures according to FIGS. 5 and 6, the water runs along the water flow arrows 42 without crossing any seam.

Figure 9:
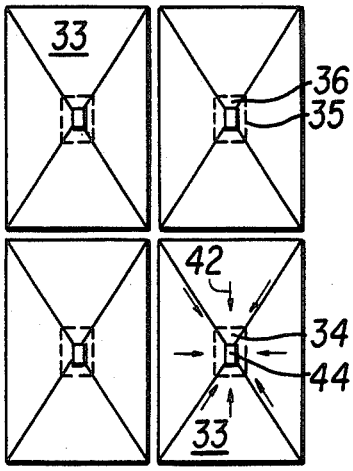
FIG. 9 is a diagrammatic plan view of a floor structure having hopper-like four-sided supporting elements.

FIG. 9 is a diagrammatic top plan view of a floor structure 1 made of quadrilaterial, hopper-like supporting elements 33. They have feet 34 which rest on square marginal areas 36 of central piers 35. The piers 35 can be in the form of hollow piers or solid piers if the collecting zones 44 are connected directly to the draining system.

Figure 7:
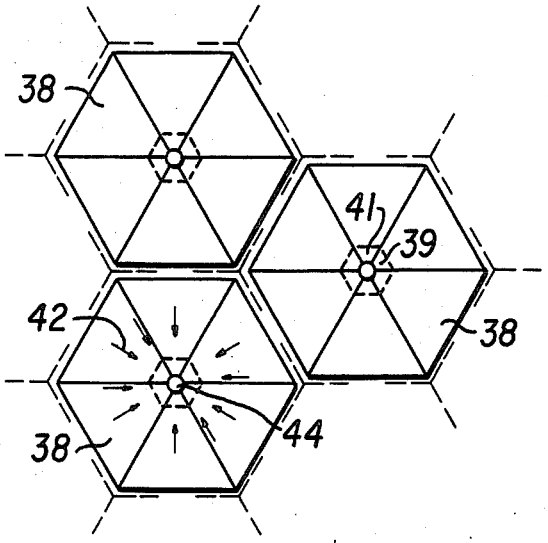
FIG. 7 is a diagrammatic plan view of a floor structure having hopper-like hexagonal supporting elements.

FIG. 7 shows a diagrammatic top view of a floor structure 1 having hexagonal, hopper-like supporting elements 38. The feet 39 rest on hexagonal marginal areas of piers 41 which can be in the form either of hollow piers or of solid piers.

Figure 8:
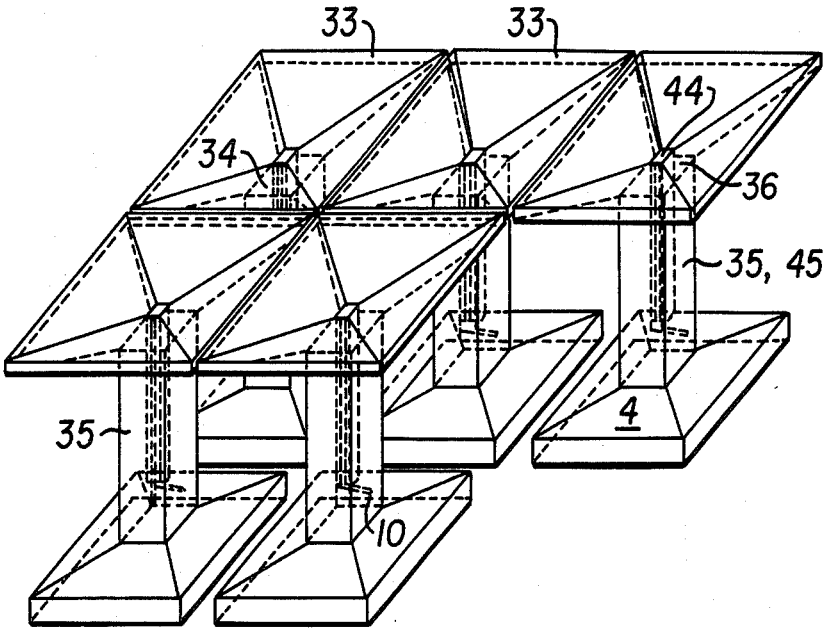
FIG. 8 is an orthographic projecting showing quadrangular, hopper-like supporting elements.

FIG. 8 shows an embodiment of a floor structure of quadrilateral, individual, hopper-like supporting elements 33 placed side by side, which are borne by a single, centrally disposed pier 35 and a block foundation 4. The feet 34 of the quadrilateral, hopper-like supporting elements 33 lie on square marginal areas 36 of the piers 35. The top surfaces of the supporting elements 33 are made concave, so that the seepage first passes inside of the hopper-like element 33 and from there through the pier 35 in the form of a hollow pier 45. They then flow down, as already described in conjunction with FIGS. 1 and 4, into the purification system. If the supporting elements 33 are larger, instead of a single, centrally disposed pier 35, a group of several piers can be made and the collecting zone 44 can be connected directly to the draining system.

Movable seams between the individual supporting elements 18, 23, 28, 33 and 38, substantially prevent the cracking of the floor structure 1 on account of differences in the settling of the individual piers 20 and 45 if the subgrade 5 is unfavorable. In such cases, the movable seams remain movable either permanently, or until the settling stops.

If this has happened, then the originally movable seams can be closed. In this case, the seam 60 is one that is movable for a limited amount of time. After the settling ends, it can finally be closed up by clamping, bolting or welding, depending on the materials of which the supporting elements are made.

Permanently closed seams 61, i.e., seams that are closed from the outset, can be made of the changes of shape of the floor structure 1 due to settling are only very small and therefore can be absorbed by the material of the supporting elements without the danger of cracking.

Figure 10:
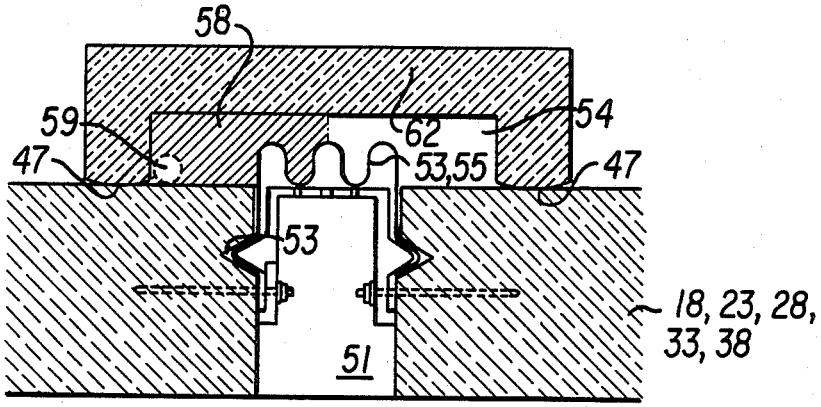
FIG. 10 is a section through a movable seam.

FIG. 10 shows a section taken through a permanently movable seam 51. The cover block 62 of [inadverted] U-shaped cross section covers the area of the seam 51 and, at its two bottom margins, lies on the confronting edges of the supporting elements 18, 23, 28, 33 and 38. The resulting seam 47 simultaneously forms the outer sealing system.

The inner sealing system 53 consists substantially of an elastically deformable seal 55 which is held between confronting V-grooves 57 in the edges of the supporting elements 18, 23, 28, 33 and 38. For this purpose a clamping plate 56 is provided, which is fastened by means of bolts in the manner represented in FIG. 10 between the confronting edges of the supporting elements.

Beneath the cover block 62 there is provided a freely draining chamber 54, which can also be filled with a waterproof composition 58. To keep the seepage out of this area of the outer seal, a drain hose 59 is used.

The waterproof composition 58 can consist, for example, or PUR [polyurethane] foam and can be removed again if necessary, and also replaced at any later time, and as often as described, with a new filling. If seepage penetrates through the seam 47 before the cover block 62 and the marginal areas of the supporting elements, this infiltrated seepage can be carried out by the drain hose 59 in a controlled manner and fed to the draining system 10, 11, 12 and 13.

Figure 11:
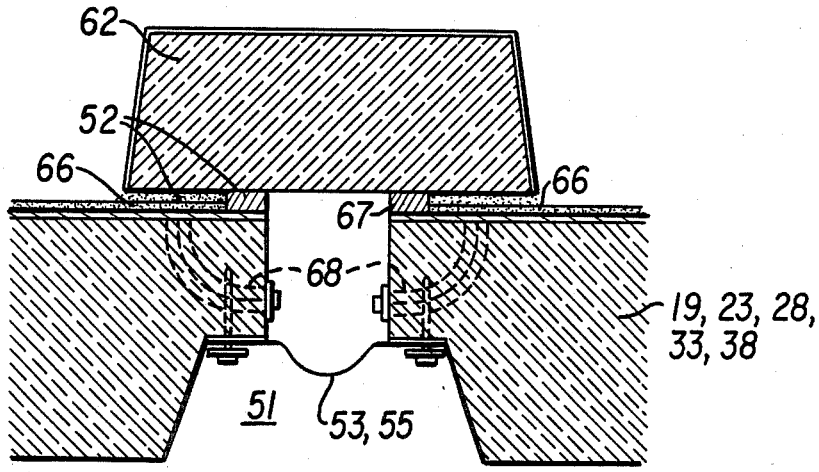
FIG. 11 is a section through another embodiment of a movable seam.

FIG. 11 shows another bipartite sealing system for a permanently movable seam 51. The cover block 62 lies on an external sealing system 52, which consists of drainage mats 66 lying on the supporting elements 18, 23, 28, 33, 38 and running along the seam 51. The freely draining chamber 54 is sealed off from the accessible floor structure 1 by an inner sealing system 53 having a resiliently deformable gasket 54. The inner sealing system 53 can easily be removed for the inspection and repair of the outer sealing system 52. The portions of the drain mats 66 facing the seam 51 are, for example, injected with Betonite. This injection process can be repeated, in case of necessity, by means of the injection tube.

While the invention has been particularly shown and described with reference to preferred embodiments thereof, it will be understood by those skilled in the art that the foregoing and other advantages in the form and detail may be made therein without departing from the spirit and scope of the invention.

I claim:

1. In a waste dump which has foundations, a subgrade, a purifying plant, a water removal system, and a waste body that produces seepage, layers of sealing material positioned under said waste material, drainage material positioned over said sealing material, means connecting said drainage material with said water removal system, a basemented floor structure positioned under said drainage material, said basement floor structure characterized in that the basemented floor structure (1) includes a plurality of piers (20, 25, 30, 35, 40), said piers having collecting zones (44) for the seepage, a plurality of individual support elements (18, 23, 28, 33, 38) each of which have feet, said individual support elements being upwardly convex or concave, separated from one another by seams (51, 60, 61), the upper surface (43) of the support elements being inclined toward said feet (19, 24, 29, 34, 39), said feet resting on said piers, whereby the burden of the waste body is transferred to said support elements, then to said piers and then onto said foundations and from there to said subgrade and, means connecting said collecting zones to said purifying plant.

2. Floor structure according to claim 1, characterized in that the supporting elements are triaxial, upwardly convex cross vaults or gable structures (18) whose feet (19) rest upon hexagonal marginal areas (21) of the piers (20).

3. Floor structure according to claim 1, characterized in that the supporting elements are four-axis, upwardly convex cross vaults or gable structures (23) whose feet (24) rest upon square marginal areas (26) of the piers (25).

4. Floor structure according to claim 1, characterized in that the supporting elements are sexaxial, upwardly convex cross vaults or gable structures (28) whose feet (29) rest upon hexagonal marginal areas (31) of the piers (30).

5. Floor structure according to claim 1, characterized in that the support elements are triangular, quadrangular or hexagonal, upwardly concave, hopper-like structural parts (33, 38) whose feet (34, 39) rest upon correspondingly shaped marginal areas (36, 41) of the piers (35, 40).

6. Floor structure according to claims 1, characterized in that each pier (20, 25, 30, 35, 40) is a hollow pier

(45) open at the top and closed at the bottom, on whose upper marginal area (21, 26, 31, 36, 41) rest the feet (19, 24, 29, 34, 39) of adjacent support elements (18, 23, 28, 33, 38) and whose cavities (46), configured as collecting zones for the seepage, are connected by conduits to the water removal system (43, 44; 10, 11, 12) and a discharge line (13) connecting said collecting zones to said purifying plant.

7. Floor structure according to claim 1, characterized in that the inclined upper surface (43) of the support elements (18, 23, 28, 33, 38) and the cavities (46) of the hollow piers (45) are provided with a one-layer or multi-layer seal (9) of protective material resistant to seepage liquid.

8. Floor structure according to claim 1, characterized in that in the support elements (18, 23, 28, 33, 36), closable openings are provided for lances (49) which can be forced upwardly into the waste body (2).

9. Floor structure according to claim 1, characterized in that the seams are constructed as permanently movable seams (5).

10. Floor structure according to claim 9, characterized in that every movable seam (51) contains a single or multiple sealing system, that a freely draining chamber (54) is disposed in the latter between the outer and inner sealing system (52, 53), and that these sealing systems are observable and repairable from the freely accessible space underneath the support elements (18, 23, 28, 33, 38).

11. Floor structure according to claim 1, characterized in that the seams are constructed as seams (60) which are movable for a limited time.

12. Floor structure according to claim 1, characterized in that the seams are constructed as permanently closed seams (61).

13. Floor structure according to claim 1, characterized in that cover blocks (62) are disposed over the seams (51, 60, 61), and bridge the immediate area of the seams.

14. Floor structure according to claim 1, characterized in that, over the support elements (18, 23, 28, 33, 38) and the layer of protective sealing material (9) as well as the layer of drainage material (8) over the latter, an additional sealing layer (63) surmounted by a drainage layer inclined over the collecting zones (44) for the seepage liquid is disposed, which is connected by vertical tubes (65) to the collecting zones (44) and to the water removal system (43, 44; 10, 11, 12, 13) and to a discharge line (13) connecting said collecting zones to said purifying plant for the seepage.

* * * * *